United States Patent [19]

Eibe

[11] Patent Number: 4,587,823

[45] Date of Patent: May 13, 1986

[54] APPARATUS AND METHOD FOR PRESS-EDGING HOT SLABS

[75] Inventor: Werner W. Eibe, McCandless Township, Allegheny County, Pa.

[73] Assignee: Blaw-Knox Corporation, Pittsburgh, Pa.

[21] Appl. No.: 693,537

[22] Filed: Jan. 22, 1985

Related U.S. Application Data

[62] Division of Ser. No. 447,790, Dec. 8, 1982, Pat. No. 4,502,311.

[51] Int. Cl.[4] ..... B21B 1/32; B21B 15/00

[52] U.S. Cl. ..... 72/206; 72/229; 72/235; 72/240; 72/366

[58] Field of Search ..... 72/206, 234, 235, 365, 72/366, 199, 229, 21, 240, 14

[56] References Cited

U.S. PATENT DOCUMENTS

| | | | |
|---|---|---|---|
| 3,580,032 | 5/1971 | Stone et al. | 72/234 X |
| 3,712,095 | 1/1973 | Dowsing et al. | 72/240 X |
| 3,757,556 | 9/1973 | Kawawa et al. | 72/366 X |
| 4,344,309 | 8/1982 | Matsuzaki | 72/366 X |
| 4,386,511 | 6/1983 | Morita | 72/366 X |
| 4,387,586 | 6/1983 | Awazuhara et al. | 72/206 |

FOREIGN PATENT DOCUMENTS

| | | | |
|---|---|---|---|
| 0035302 | 9/1981 | European Pat. Off. | 72/366 |
| 0014004 | 2/1981 | Japan | 72/366 |

*Primary Examiner*—Francis S. Husar
*Assistant Examiner*—Steve Katz
*Attorney, Agent, or Firm*—Walter J. Blenko, Jr.; Arnold B. Silverman

[57] ABSTRACT

The apparatus and method make possible the semicontinuous rolling of an extensive range of product widths from no more than three widths of slabs. The leading end of a slab is forged or upset laterally between dies tapered to reduce its width at said end gradually to a value less than the desired width at the end of the pass. The slab is then passed through grooved vertical edging rolls to reduce its width and into the rolls of a roughing stand. The edge rolling tends to move the overfilled metal into the void created by the dies. As the trailing end of the slab approaches the roughing stand the edging rolls are backed off, allowing that end of the slab to fan out laterally. As the slab leaves the roughing stand it is rolled between grooved vertical edging rolls to reduce spread and bring the fanned-out trailing end to size. That operation causes the trailing end to bulge rearwardly at its center, so compensating for fishtailing. The roughing stand is then reversed and the slab rerolled in the opposite direction in the same way.

3 Claims, 16 Drawing Figures

APPARATUS AND METHOD FOR PRESS-EDGING HOT SLABS

This is a division, of application Ser. No. 447,790, filed Dec. 8, 1982 U.S. Pat. No. 4,502,311.

This invention relates to the hot rolling of slabs of steel and other metals to transfer bars in a hot strip mill. It is more particularly concerned with apparatus and method for hot working slabs from a continuous caster to transfer bars of lesser width and thickness.

BACKGROUND OF THE INVENTION

Conventional hot strip mills have been designed for rolling slabs from a primary slab mill which is capable of providing slabs of any desired width for subsequent continuous rolling. Continuous slab casters, however, operate most efficiently at a constant slab width and thickness. Dimensional changes are accomplished by changing molds, which is time consuming, and requires a considerable mold inventory, or by using molds of adjustable dimensions, which molds are costly and give rise to difficulties not encountered by molds of fixed dimensions. It is pointed out in Stone U.S. Pat. No. 3,580,032 that to cast slabs in a width range of 32 inches to 74 inches requires as many as 20 molds.

Efforts have therefore been made to reduce the widths of continuously cast slabs by edge rolling or pressing prior to thickness reduction, both of which techniques are described in the Stone patent above mentioned. Reduction of a few inches can be made by edge rolling without too much shape distortion but heavy edge rolling of hot slabs thickens the slab edges with respect to its center portion, which effect is known as "dog-boning". A schematic cross section of a slab so rolled is shown in FIG. 6 hereof. When that slab is rolled through the following thickness-reducing stand, however, some of the excess metal at the ends of the dog-bone is rolled out transversely, so that the net reduction in product width is appreciably less than that provided by the edging pass. This is shown in FIG. 7 hereof. The remaining excess metal is rolled longitudinally to a somewhat greater length along the edges of the slab than at its center, producing the "fishtail" shown in FIG. 5 hereof. This fishtail has to be cropped and so appreciably reduces the yield from the slab.

Grooved edging rolls produce somewhat better results than cylindrical rolls but require the groove contour to be matched to the slab thickness. In the Stone patent edger rolls with grooves of adjustable width are provided for that purpose. While the width of the groove can be changed in that way, the angle of inclination of the sides of the groove to its base are fixed.

It has also been proposed to upset or forge the trailing end of a slab transversely to create voids which will fill in during subsequent horizontal rolling so as to minimize or eliminate fishtailing. Again the shape of the void varies with the width of the slab and the amount of width reduction required, and a considerable inventory of dies for that purpose must be maintained.

THE INVENTOR'S SOLUTION TO THE PROBLEM

I have invented a semi-continuous method of slab rolling which requires no more than three widths of slabs for a 68" strip mill covering the range of product widths from 24" to 61.5" and produces transfer bars essentially free of fishtails. I have also invented apparatus for use with a reversing roughing stand for carrying out my process above mentioned.

In my process, which is preferably carried out in several passes, I forge or upset the leading end of the slab laterally between dies tapered to reduce its then width at its end gradually to a value less than the desired width at the end of the pass. I then pass the slab through vertical edging rolls formed with grooves having contours similar to those of the die, so reducing the slab width, and into the rolls of the roughing stand. The edge rolling tends to move the overfilled metal ahead into the voids created by the dies. As the trailing end of the slab approaches the roughing stand, I back-off the edging rolls, so allowing that end of the slab to fan out laterally. The slab tends to spread laterally in the roughing stand and as it exits therefrom I roll it between grooved vertical edging rolls to reduce that spread. That edge rolling continues as the trailing end of the slab leaves the roughing stand, so rolling the fanned-out trailing end to size. That rolling causes the trailing end to bulge rearwardly at its center so as to compensate for fishtailing resulting as the metal leaves the pass between the edging rolls. The roughing stand is then reversed and the slab is rolled back through it, again being worked on what was the exit side of the stand in the same way it was on the original entry side.

My apparatus may be attached to a conventional roughing stand housing or it may be independently supported. It comprises supporting means holding vertical drive shafts and a frame rotatable thereabout on each side of the mill table. To each frame is affixed a pair of arms intermediate its ends carrying at one end a grooved tapered pressing die and at the other a grooved edging roll. Between one pair of ends is connected power driven screw means for swinging the arms toward and away from each other and applying working pressure to the dies or rolls. A nut for each screw is hydraulically adjustable along the screw axis for close screw control purposes and a linear transducer is connected between the other pair of ends of the arms to control fluid supply means to the adjustable nuts. The dies and rolls have two or more grooves and the frames are mounted on hydraulic cylinders to raise or lower them so as to align the desired grooves with the pass line of the roughing stand. The drive shafts and the shafts holding the vertical edging rolls are provided with mating gears and the drive shafts are driven at their lower ends through bevel gears.

DESCRIPTION OF PREFERRED EMBODIMENT OF MY APPARATUS

Figure 1:
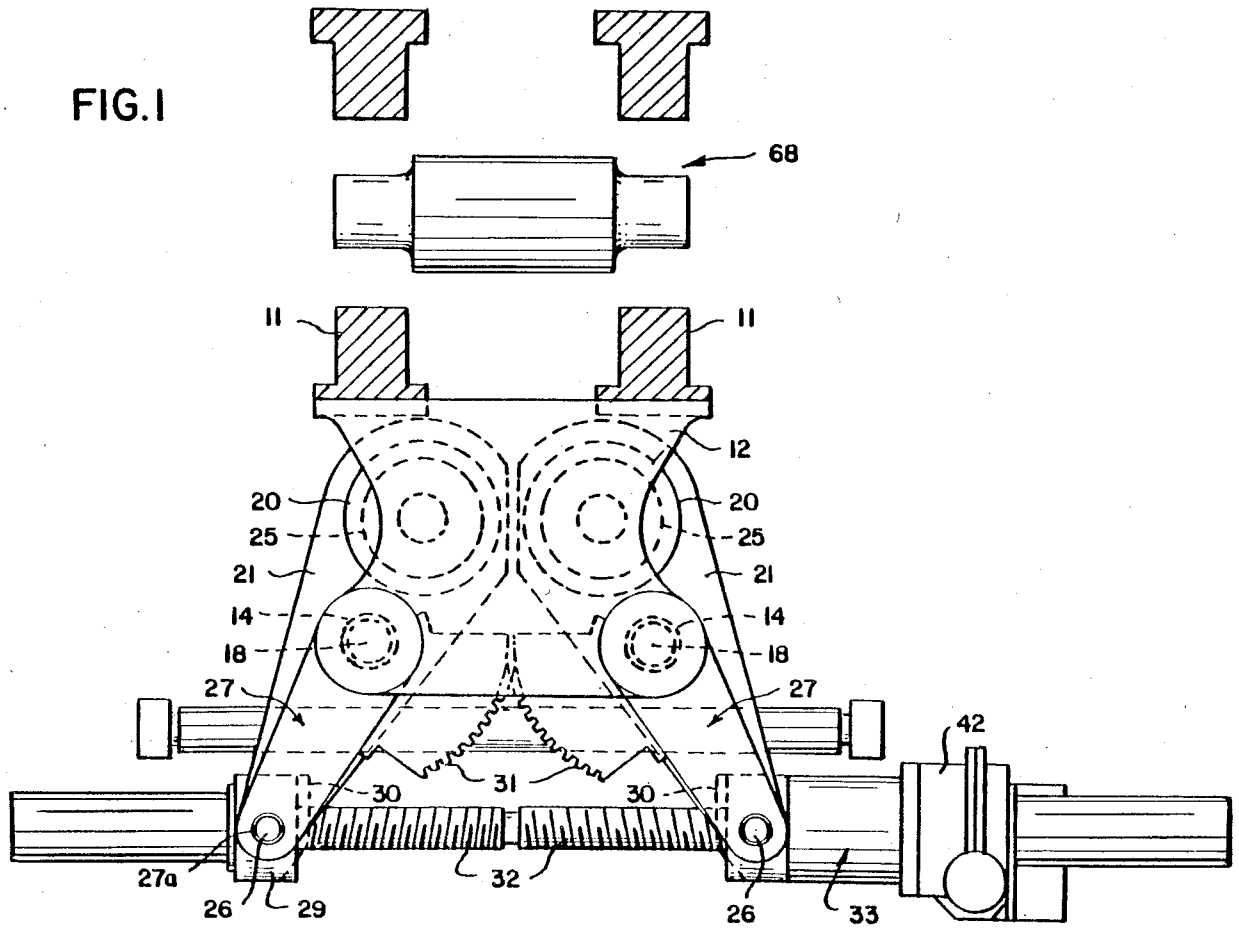
FIG. 1 is a plan view of the apparatus of my invention.
Figure 2:
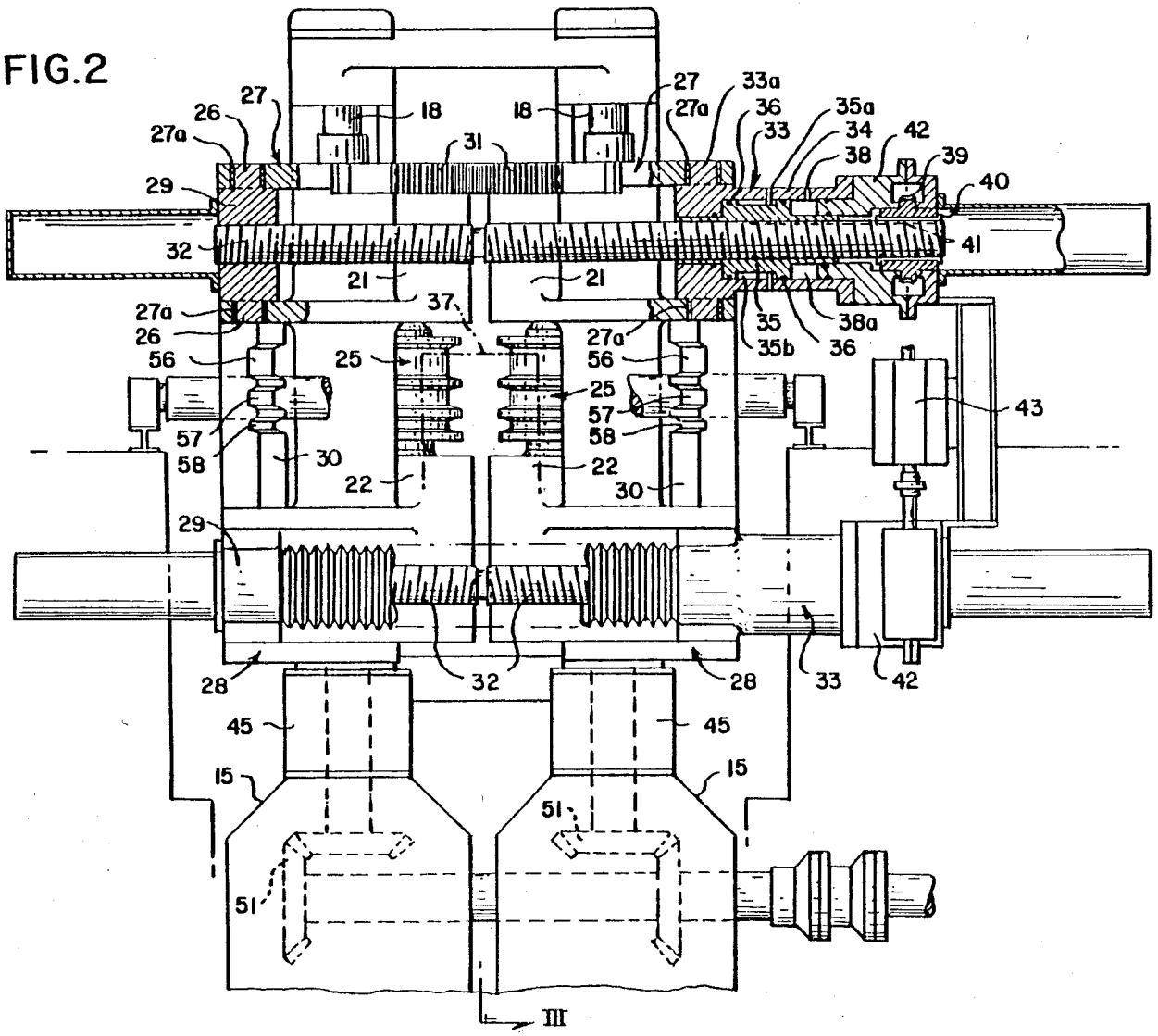
FIG. 2 is an end elevational view partly in section of the apparatus of FIG. 1 transverse to the pass line of the mill.
Figure 3:
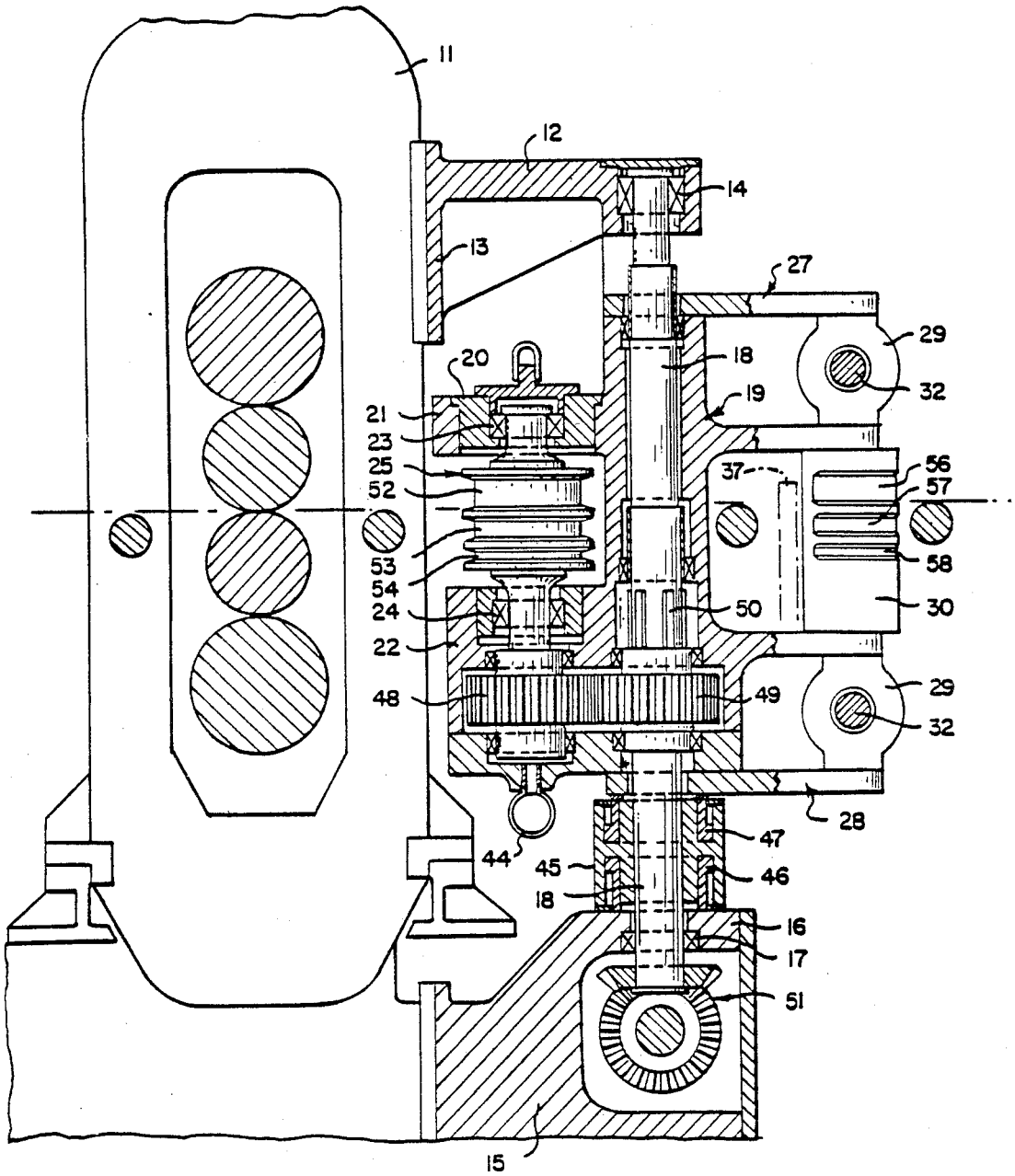
FIG. 3 is a sectional view taken on the line III—III of FIG. 2.

My apparatus is shown in FIGS. 1, 2 and 3 attached to the housings 11 of a conventional roughing stand. A horizontal upper cross member 12 is formed with vertical flanges 13 at its inner end which are affixed to housings 11 near their upper ends. The outer end of cross member 12 carries vertical bearings 14, one on each side of the roughing stand, aligned with housings 11 thereof. Supporting structures 15 positioned below the floor and aligned vertically with mill housings 11 have horizontal top plates 16 which carry vertical bearings 17 aligned with bearings 14. In those pairs of bearings are journalled drive shafts 18, one on each side of the roughing stand. Pivotally mounted on each drive shaft 18 is a frame structure 19 surrounding drive shaft 18 and provided with upper and lower arms 21 and 22 respectively projecting horizontally therefrom. The outer ends of each arm 21 and 22 carry aligned bearings 23 and 24 respectively which journal the necks of a vertical edging roll 25, to be described more fully hereinafter. Bearings 23 are carried in removable cylindrical mountings 20 which are of somewhat greater diameter than edging rolls 25 permitting those rolls to be removed vertically through upper arms 21 when necessary. Extending from frame 19 in the direction opposite from arms 21 and 22 are bifurcated horizontal upper and lower arms 27 and 28 respectively, parallel to each other. Blocks 29 having pivot shafts 26 are pivotally mounted in bearings 27*a* in the outer ends of the left hand bifurcated upper arm 27, as shown in FIG. 2, and also in the ends of left hand bifurcated lower arm 28, not shown. Between each pair of arms 27 and 28 is carried a forging die 30, to be described more fully hereinafter. A stop 37, shown in chain line in FIGS. 2 and 3, is vertically movable from below the pass line to above it by conventional means not shown. Stop 37 positions slabs properly with respect to dies 30. Blocks 29 are horizontally bored and threaded for upper and lower threaded horizontal screws 32. The ends of screws 32 are oppositely threaded and when rotated move the outer ends of arms 27 and 28 respectively together or apart. Mating gear segments 31 coaxial with drive shafts 18 are affixed to arms 27. In arms 27 and 28, on the right side of the roughing stand as viewed in FIG. 2, upper and lower blocks 33 have bearings 27*a* pivotable about pivot shafts 33*a* and carry outwardly extending cylindrical housings 34. A nut 35 is threaded on each screw 32 within each housing 34 with clearance between its periphery and the interior of housing 34 except for seals 36 at each end of nut 35. Nut 35 is held against rotation with respect to housing 34 by screws 35*a* in keyways 35*b*. A source of hydraulic fluid under pressure is connected with the clearance space above mentioned through an aperature 38 in the wall of housing 34. Near the outer end of each housing 34 a rotatable wormgear 39 is mounted on screw 32 keyed thereon for slidable movement by a key 40 in a keyway 41 in screw 32 and wormgear 39. Wormgear 39 is driven by electric motor 43 through a worm not shown.

Referring now to FIG. 3, duplex hydraulic cylinders 45 are mounted on and coaxial with drive shaft 18 between frame structure 19 and supporting plates 16. Each cylinder comprises a lower piston 46 which abuts top plate 16 and an upper piston 47 on which rests frame 19. The stroke of lower piston 46 is longer than that of upper piston 47. Drive shafts 18 are driven at their lower ends through conventional bevel gearing 51 by drive motors not shown. The lower necks of vertical edging rolls 25 carry gears 48 which mesh with gears 49 mounted on drive shafts 18 through splines 50, allowing vertical movement between gear 49 and shaft 18.

Figure 8:
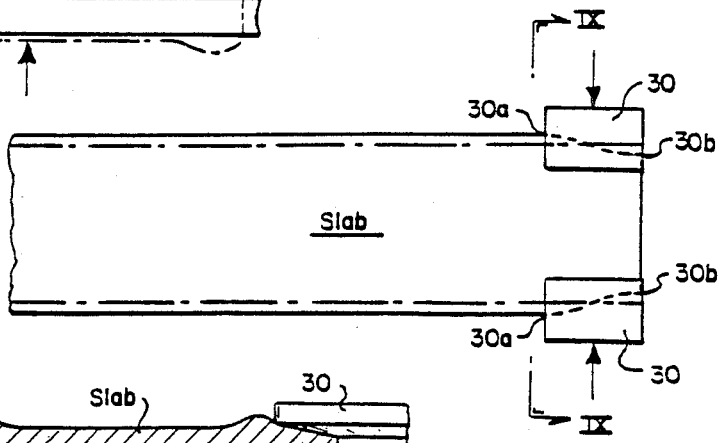
FIG. 8 is a plan partly broken away of a slab with its end upset by the dies of my invention.
Figure 9:
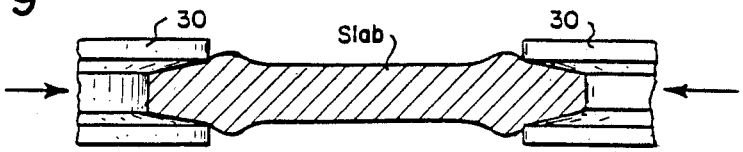
FIG. 9 is an enlarged section taken on the line IX—IX of FIG. 8.

Edging rolls 25 are formed with three flat-bottom grooves 52, 53 and 54 of width corresponding to three different slab thicknesses. Forging dies 30 are also formed with three flat-bottom grooves 56, 57 and 58 having the same contours as grooves 52, 53 and 54 respectively and superimposed in the same order. Edging rolls 25 of my apparatus have grooves 52, 53 and 54 of the contour shown in FIGS. 2 and 3. My dies 30 for preforming the slab end by forging or upsetting have grooves 56, 57 and 58 of contour similar at their entry ends to those of the corresponding grooves of rolls 25 as I have mentioned. Those grooves in dies 30, however, taper over the length of the die from maximum depth at the entry end 30*a* of the die to minimum depth at the other end 30*b*, as is shown in FIG. 8. The dies are forced against the edges of the slab normal thereto and taper the slab end gradually as is shown in the FIGS. 8 and 9. This action upsets the slab adjoining its edges, as is shown in FIG. 9. The dog-bone contour there shown is maximum at the entry end of the die and tapers to a minimum over the length of the die, that is the bulges on each side of the slab are reduced in height in that fashion. The precise contours of the grooves transversely and longitudinally of the dies depend on the width and thickness of the slab.

OPERATION OF PREFERRED EMBODIMENT OF MY APPARATUS

Figure 4:
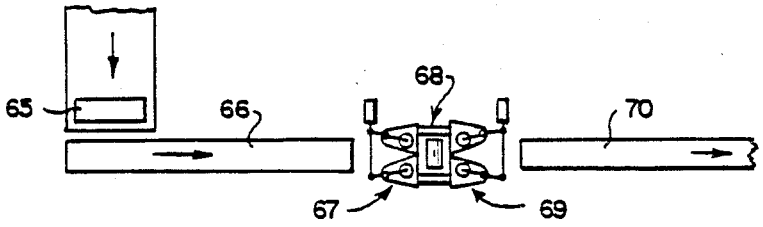
FIG. 4 is a schematic plan of a semi-continuous roughing mill of my invention for rolling continuously cast slabs.

I prefer to position units of my apparatus back-to-back on either side of a reversing roughing stand as is shown in FIG. 4. Continuously cast slabs from a slab furnace 65 are discharged onto a conveyor table 66 and transferred to a first preform-edge rolling mill 67, then through reversing roughing stand 68, then through a second preform-edging mill 69 and on to discharge conveyor table 70. The preforming-edge rolling mills 67 and 69 are positioned on each side of roughing stand 8 back-to-back as has been mentioned, that is, with the edging rolls of each mill nearer the roughing stand.

Figure 5:
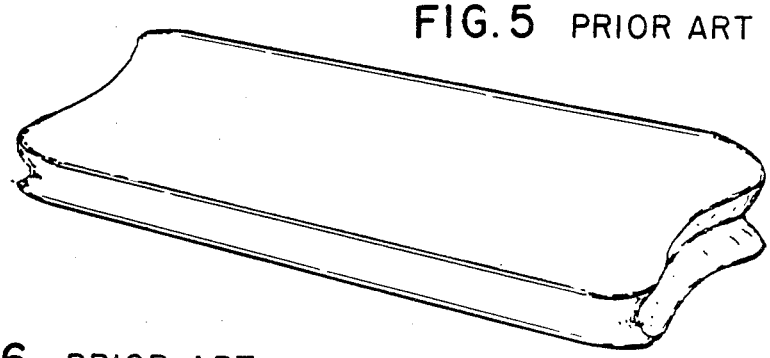
FIG. 5 PRIOR ART
FIG. 5 is an isometric sketch of a continuously cast slab horizontally rolled and heavily edged in accordance with the prior art.
Figure 6:
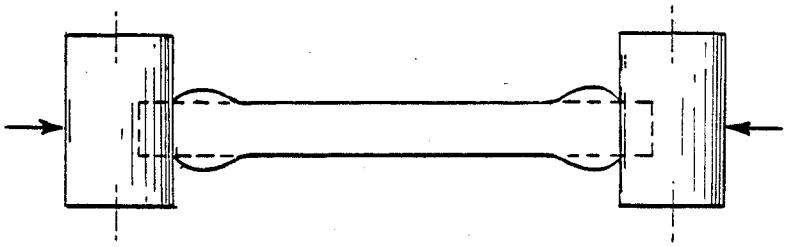
FIG. 6 PRIOR ART
FIG. 6 is a cross section of a slab edge rolled in accordance with the prior art.
Figure 7:
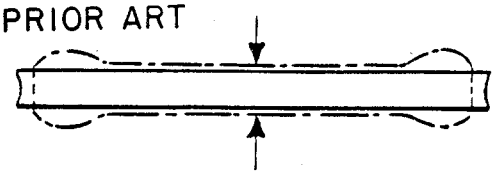
FIG. 7 PRIOR ART
FIG. 7 is a cross section of the slab of FIG. 6 after horizontal rolling in accordance with the prior art.

The slab is moved along conveyor table 66 into my apparatus between preforming dies 30, being properly positioned by stop 37 at the exit ends of the dies, which dies are then forced against the slab end by screws 32 which are rotated by motor 43 turning wormgear 39. Screws 22 are threaded in opposite directions at their two ends through threaded blocks 29 and opposite blocks 33. A linear transducer 44 shown in FIG. 3 is provided to indicate the spacing between arms 22, and therefore of the spacing between dies 30, through a conventional electro-hydraulic servo system not shown. This servo system keeps an accurate distance between the rolls 25 under a conventional closed loop control system, which greatly reduces the necking of the slab ends as shown in FIG. 5 as occurs with conventional non-hydraulic edging mills. Nut 35 acts as a piston within housing 34 and fine adjustment of die or roll stroke is accomplished by admitting hydraulic fluid through port 38 into the space 38*a* in housing 34 between nut 35 and wormgear housing 42 attached to the end of housing 34. Looking at FIG. 2, when hydraulic fluid is admitted to space 38*a*, nut 35 and consequently screw 32 are caused to move left while wormgear housing 42 moves right. Movement of screw 32 to the left causes block 29 to pivot and move rolls 25 in a closing direction. Movement of wormgear housing 42 to the right causes block 33 to pivot and thus move rolls 25 in a closing direction. All movement of rolls 25 and dies 30 are synchronized through meshed segmented gears 31. Screws 32 permit this adjustment because they move longitudinally through wormgear 39. After the leading end of the slab has been upset or forged by dies 30 as is shown in FIGS. 8 and 9, the dies are swung away from the slab, stop 37 is retracted and the slab is moved into edging rolls 25 and rolled therethrough between them over its entire length.

In FIGS. 2 and 3 edging rolls 25 and dies 30 are shown with their widest grooves, 52 and 56 respectively, at the pass line of the roughing stand. To process slabs of the next narrower thickness, hydraulic fluid is introduced into hydraulic cylinders 45 which raise frame 19 and the dies and rolls to bring edging rolls grooves 53 and die grooves 57 to the pass line. Similarly, when slabs of the last thickness are to be processed additional hydraulic fluid is admitted to hydraulic cylinder 45. Drive gears 48 and 49 are captive within a housing 19*a* in arms 22 and 28 so that they rise together with frame structure 19 and remain in mesh.

DESCRIPTION OF PREFERRED EMBODIMENT OF MY PROCESS

Figure 10:
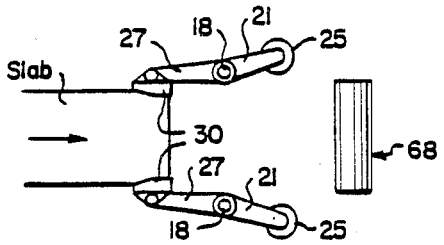
FIGS. 10 through 16 represent diagrammatically in plan views the steps of rolling a slab in a roughing stand together with my apparatus in accordance with my process.
Figure 11:
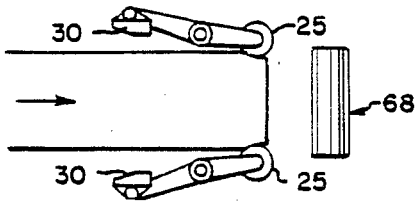
Figure 12:
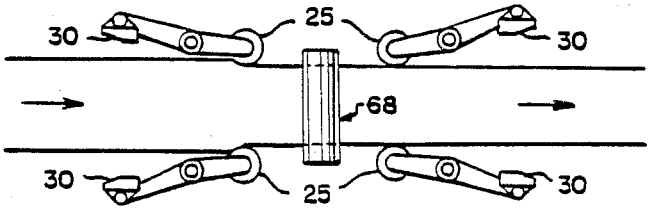
Figure 13:
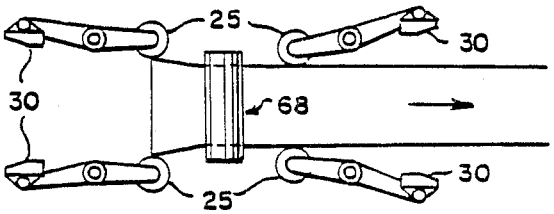
Figure 14:
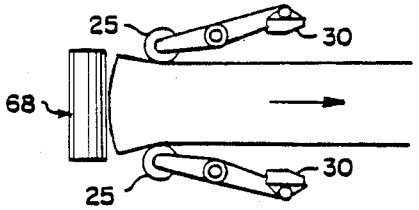
Figure 15:
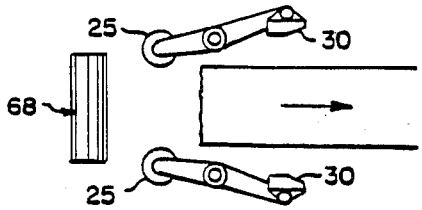
Figure 16:
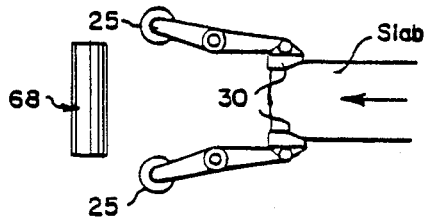

The various stages of my preferred process are shown diagrammatically in FIGS. 10–16. The leading end of the slab is first upset while the slab is stationary by my preforming dies to taper that end of the slab laterally as is shown in FIG. 10. Its end's width is reduced below the final width desired for this pass but the slab in that region will have a dog-bone cross section as has been mentioned. The slab is then rolled between my grooved edge rolls as is shown in FIG. 11. This rolling moves some of the metal upset by my dies into the cavities of the slab end produced by the previous step, and as the rolling advances the slab through the roughing stand as is shown in FIG. 12, its dog-bone cross section is rendered rectangular, at the expense of some leading end fishtailing and some lateral spreading. The edging roll spacing is not changed until the trailing end of the slab approaches, when the spacing is gradually widened permitting the trailing end of the slab to fan out laterally as is shown in FIG. 13, so reducing the dog-boning effect to zero. As this end is then rolled through the roughing stand the slab is elongated more along the center line than at its edges, since there is no dog-bone to be rolled out, resulting in rearward bulging as is shown in FIG. 14. At the same time the bulge of the slab is being edge rolled through the edging rolls of my apparatus positioned at the delivery side of the roughing stand to counteract the spreading resulting from the pass through the roughing stand. The pressure exerted by the edging rolls on the trailing end causes some of the metal in the fanned edge to elongate, thus counteracting the center bulge and producing a slab with a relatively square trailing end. The slab is then reversed in direction of travel and the preceding cycle of operations is repeated in the reverse direction. However, since the slab has been reduced in thickness by the horizontal mill the next smaller groove of the edging mill is brought into action by raising the rolls.

In the foregoing specification I have described a presently preferred embodiment of my invention; however, it will be understood that my invention can be otherwise embodied within the scope of the following claims.

I claim:

1. The method of hot rolling a metal slab in a plurality of mill stands to a transfer bar of reduced thickness, reduced width and substantially rectangular plan comprising forging the leading end of the slab to taper it to an end width less than the reduced width desired for the pass, thus upsetting the slab at that end, edge rolling the slab from the tapered end throughout its length, thereby further upsetting the slab and transferring upset metal into the voids left by said forging, rolling the edge rolled slab in a mill stand to reduce the thickness of and elongate the slab, thereby spreading it laterally, gradually reducing the edge rolling as the trailing end of the slab enters said thickness reducing mill stand, thereby allowing the trailing end to fan out to an increased width and to bulge rearwardly from its fanned edges, and edge rolling the trailing end of the slab to the desired width after it exits from the mill stand, thereby transferring metal to fill the corners of the fanned-out trailing end.

2. The method of hot rolling a metal slab in a plurality of mill stands to narrow the slab to a desired width and reduce trailing end fishtailing comprising edge rolling the slab, thus upsetting it, passing the edge rolled slab into a thickness reducing mill stand while the trailing end of the slab is being edge rolled, gradually reducing the trailing end edge rolling, thus allowing the trailing end to fan out to an increased width and bulge rearwardly from its fanned edges, and edge rolling only the trailing end of the slab only to said desired width after it exits from said thickness reducing mill stand, thereby causing sufficient fishtailing to fill the corners of the fanned trailing end.

3. The method of claim 2 including the further step of reversing the travel of the slab, forging the now leading end of the bar to taper it to an end width less than the reduced width desired, then upsetting it at that end, edge rolling the slab from the tapered end, and rolling it through said thickness reducing mill stand in the reverse direction, thereby causing sufficient front end fishtailing to fill the voids of the tapered leading end.

* * * * *